United States Patent [19]

Conan

[11] Patent Number: 4,480,444

[45] Date of Patent: Nov. 6, 1984

[54] DEEP MINE COOLING SYSTEM

[75] Inventor: Jean Conan, Kercradet, France

[73] Assignee: Alsthom-Atlantique, Paris, France

[21] Appl. No.: 497,342

[22] Filed: May 23, 1983

[51] Int. Cl.[3] ..... F25D 9/00

[52] U.S. Cl. ..... 62/402; 62/238.3; 62/476

[58] Field of Search ..... 62/86, 87, 88, 401, 62/402, 476, 238.3, 238.4

[56] References Cited

U.S. PATENT DOCUMENTS

| | | | |
|---|---|---|---|
| 2,069,269 | 2/1937 | Perkins | 62/87 |
| 2,494,120 | 1/1950 | Ferro, Jr. | 62/87 |
| 3,091,941 | 6/1943 | Becker | 62/87 |

*Primary Examiner*—Ronald C. Capossela
*Attorney, Agent, or Firm*—Sughrue, Mion, Zinn, Macpeak, and Seas

[57] ABSTRACT

A deep mine cooling system comprising a compressor supplied with air and rotatively driven by a motor and an expansion turbine supplied with compressed air from said compressor and driving an actuating unit, wherein the compressed air, after leaving the compressor but prior to reaching the expansion turbine, passes through a steam generator whose output provides the energy required to operate an absorption refrigeration machine used to cool utility water for mining, said compressed air on leaving the steam generator going to a first heat exchanger in which it yields calories to a water circuit comprising a second heat exchanger, said second heat exchanger giving off the calories absorbed by the water in the first heat exchanger to the air fed by the second heat exchanger to a drying cell that is regenerated by said air from the second heat exchanger, said drying cell being part of a set of two cells working in alternation, the other cell in the set receiving the compressed air from the first heat exchanger, such that the compressed air is fed to said expansion turbine after leaving said drying unit, and wherein the air exhausted from said expansion turbine is sent to a third heat exchanger after which it is distributed according to the needs of the mine, said third exchanger being traversed by the water collected in the mine, cooled in said exchanger and circulated upon leaving said exchanger to meet the cool water requirements of the mine.

3 Claims, 2 Drawing Figures

DEEP MINE COOLING SYSTEM

This invention relates to a cooling system for deep mines.

Prior art cooling systems for deep mines to a depth of 2000 meters are based on chilled water circulation. The cold water is prepared either on the surface or in the sump. Such a system can be employed down to a certain depth that depends on the condition of the mine passageways, including wall temperature, rock moisture content and other factors. However, the cost of such an installation increases considerably with depth, becoming excessive when depths of 3000 to 4000 meters are involved.

The object of this invention is to provide a cooling installation for deep mines which avoids this disadvantage.

The deep mine cooling system according to the invention comprises a compressor supplied with air, said compressor being rotatively driven by a motor, and an expansion turbine, supplied with compressed air from the compressor, which drives an actuating unit. A main feature of this cooling system is that the compressed air, upon leaving the compressor and prior to being sent to the expansion turbine, is sent through a steam generator whose steam output provides energy for operating an absorption refrigeration machine used to cool utility water used in mining, said compressed air on leaving the steam generator going to a first heat exchanger wherein it gives off calories to a water circuit comprising a second heat exchanger, said second heat exchanger giving off the calories absorbed by the water in the first heat exchanger to the air fed by the second heat exchanger to a drying cell that is regenerated by said air from the second heat exchanger, said drying cell being part of a set of two cells working in alternation, the other cell in the set receiving the compressed air delivered by the first heat exchanger, such that the compressed air is fed to said expansion turbine when leaving said drying unit. A second feature is that the air, upon leaving said expansion turbine, is sent to a third heat exchanger after which it is distributed according to the requirements of the mine, said third exchanger being traversed by the water collected in the mine, said collected water being cooled in the third exchanger and circulated to meet the cool water requirements of the mine.

In one embodiment of the invention, the compressed air, upon leaving the drying unit, is further cooled by passing through a fourth heat exchanger and said absorption refrigeration machine and said fourth heat exchanger are both supplied with cooling water from an above-ground cooling tower.

Figure 1:
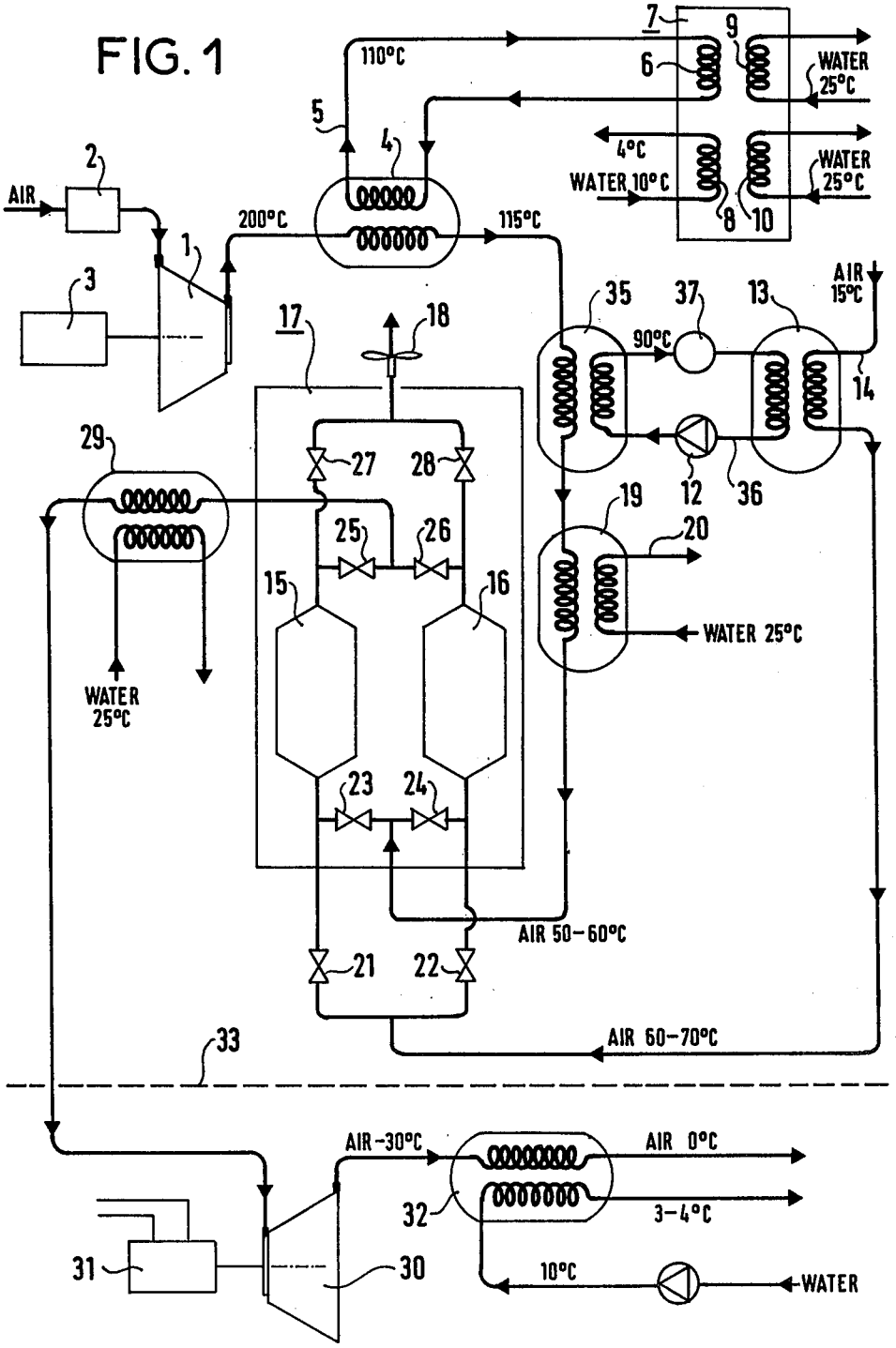
Figure 2:
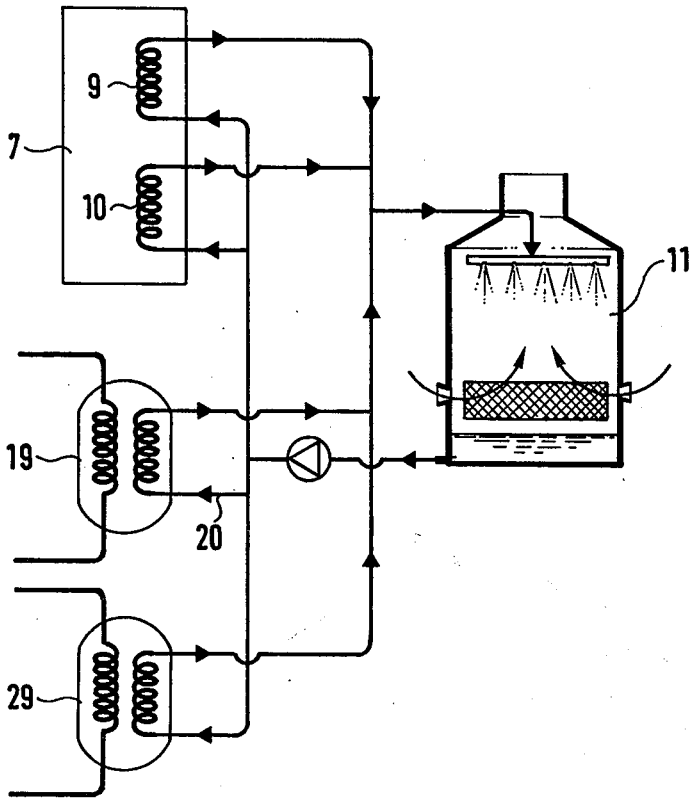

An example of a cooling system according to the invention is described hereunder with reference to the appended drawing in which:

FIG. 1 is a schematic drawing of a cooling system for deep mines according to the invention, and FIG. 2 is a schematic drawing of an additional cooling cycle supplementing the system of FIG. 1, using water from a cooling tower.

The system shown consists of a compressor 1 supplied with air via a filter 2 and rotatively driven by a motor 3.

The compressor delivers compressed air at a temperature of about 200° C. to a steam generator 4, which generates, in a water circuit 5, steam used in an exchanger 6 as an energy source to operate an absorption refrigeration machine represented as a rectangle 7 in the drawing.

Said refrigeration machine is used to provide, at the outlet of another exchanger 8, water at a temperature of 4° C., using water at 10° C. collected from the mine. This water, at a temperature of approximately 4° C., can be used for production purposes, in the mine's upper stopes for example, and also as make-up water for the lower stopes.

The refrigeration machine 7 is supplied with cooling water coming from a cooling tower 11 (FIG. 2) and delivers this water to heat exchangers 9 and 10.

The compressed air, which after going through the steam generator 4, has cooled to about 115° C., circulates through a first air/water heat exchanger 35 in which it yields its calories to a water circuit 36 comprising a storage tank 37 and a circulation pump 12. A second, water/air heat exchanger 13 imparts the calories collected by the water in the water circuit 10 to an external air flow 14 at a temperature of about 15° C. This air is warmed to about 60° to 70° C. and sent to one of the two cells 15, 16 of a drying plant 17 in order to regenerate said cell. The drying cells 15, 16 work in alternation such that one is always being regenerated while the other is working. The regenerating air flow 14 is discharged from the drying plant 17 via an exhauster 18.

Upon leaving the first air/water heat exchanger 35 and prior to being sent to the drying plant 17, the compressed air is sent, if required, to a fifth air/water heat exchanger 19 the water loop of which 20 is cooled by the surface cooling tower 11.

On leaving the exchanger 19, the compressed air, now at a temperature of about 50° to 60° C., is sent to the drying plant 17 and treated by whichever of the two cells 15 or 16 is not undergoing regeneration. Valves 21 through 28 are provided to enable correct routing of both compressed air flows and regeneration air flows 14 to the appropriate cell.

In circulating through the drying plant 17 the compressed air is warmed, since the dehydration process is an exothermic one. Thus, said compressed air should preferably be sent through a fourth air/water heat exchanger 29 communicating with the cooling tower 11.

Finally, the compressed air is expanded in an expansion turbine 30 which delivers air at a temperature of around −25° to −30° C. The mechanical power supplied by the turbine is used to drive an alternator 31 feeding the mine's power grid.

The expanded air leaving the turbine 30 is sent to a third air/water heat exchanger 32 where it is warmed to 0° C. in the process of cooling the water in the exchanger from 10° C. to approximately +3° to +4° C., the latter water being part of the used water collected in the mine. Said cooled water is then made to circulate either through a series of central air conditioners or stope air conditioners or for industrial purposes. The 0° C. air is then dispatched via a duct network to the stopes or to other spaces requiring air cooling and flushing. The used air, warmed to 28° to 30° C. and imparted a relative humidity close to saturation, is exhausted to the atmosphere via the extraction shafts of the mine.

The third air/water exchanger 32 is a finned-tube water chiller designed to deliver water at a constant temperature of roughly +3° to +4° C. while ensuring that said water will not freeze under any circumstances, thanks to the use of a secondary fluid.

A line, labelled 33, has been drawn in FIG. 1 to separate the part of the installation located above-ground and diagrammed above the line from the installation located at the bottom of the mine and diagrammed below the line.

The cooling system according to the invention, as compared with a conventional mine cooling system employing bulk water and air cooling plants located either at the surface or underground, provides the following advantages:

it eliminates the need to pump huge quantitites of water back up to the surface, thus saving the energy which would be required for this purpose, said energy requirement being considerable in all cases, even if the rising column of water is used underground to power Pelton turbines driving electric generators;

it increases the cooling potential of each kilogram of ventilation air as this air is delivered on the one hand at low temperatures of around 0° C. to the places requiring cool air and is on the other hand very dry air with a dew point of around −30° C. providing 30% to 80% more latent heat carriage capability, depending on the atmospheric conditions obtaining outside the mine (the latent heat content of saturated air at +28° C. is roughly 65% to 70% of the total heat);

it makes it possible to precool on the surface all the make-up water required underground and probably also to cover the cooling needs in terms of industrial water for the mine's upper stopes and roads (down to a depth of 1000 to 2000 meters);

it makes it possible, assuming that the refrigeration produced aboveground is not put to better use, to recover about 12.5 kilograms of water per ton of ventilation air by merely cooling the exhaust air to 15° to 16° C., thus affording a saving on expenditures for make-up water;

it eliminates the need for underground use of pressurized refrigerants, which, however safe, can nevertheless induce narcosis and can, in the presence of flames or sparks, break down into very dangerous compounds such as phosgene, and thus require a certain amount of air flushing since they are denser than air. In the cooling systems according to the invention, water and air alone are circulated and a fluid at a pressure less than atmospheric pressure is used in the underground water coolers.

The system according to the invention moreover makes it possible to generate locally, underground a part of the electrical power required for mine utilities and thus to reduce the diameter of power cables from the surface.

The air compression and expansion system employed in the cooling system according to the invention also eliminates the need for ventilation fans as used in conventional systems.

I claim:

1. A deep mine cooling system comprising:

a motor driven air compressor, an expansion turbine, conduit means coupling said air compressor to said expansion turbine for supplying compressed air to said expansion turbine for driving said expansion turbine, a drying plant connected to said conduit means and intermediate of said motor driven air compressor and said expansion turbine, a steam generator connected by said conduit means downstream of said compressor and upstream of said drying plant, a first heat exchanger connected by said conduit means downstream of said steam generator and upstream of said drying plant, said drying plant comprising a set of two cells, said conduit means including means for alternately supplying compressed air from said compressor to said cells, an absorption refrigeration system including a plurality of heat exchangers, means for connecting the output of said steam generator to a heat exchanger of said absorption refrigeration system functioning as an energy source exchanger, said first heat exchanger comprising a water circuit, a second heat exchanger within said water circuit, means for feeding air through said second heat exchanger and to one of said drying cells for regeneration of said drying cell by air from said second heat exchanger such that said second heat exchanger gives off calories absorbed by the water circuit derived from compressed air passing through said first heat exchanger, said absorption refrigeration system comprising means to cool utility water for mining; whereby, the compressed air may be fed to said expansion turbine after leaving said drying plant, a third heat exchanger connected by said conduit means to the output of said expansion turbine whose output may be distributed according to the needs of the mine, means for connecting water collected in the mine to said third heat exchanger for cooling in said third heat exchanger and permitting circulation upon leaving said third heat exchanger to meet the cool water requirements of the mine.

2. A cooling system as claimed in claim 1, further comprising a fourth heat exchanger, said conduit means connecting said fourth heat exchanger between said drying plant and said expansion turbine, and means for supplying said absorption refrigeration system and said fourth heat exchanger with cooling water from an above-ground cooling tower such that said compressed air is further cooled after passage from said drying plant and prior to entering said expansion turbine.

3. The cooling system as claimed in claim 2, further comprising a fifth heat exchanger, said conduit means connecting said fifth heat exchanger downstream of said first heat exchanger and between said first heat exchanger and said drying plant, and means for supplying cooling water from said above-ground cooling tower to said fifth heat exchanger, such that said compressed air upon leaving said first heat exchanger is further cooled by passing through said fifth heat exchanger prior to entering said drying plant.

* * * * *